United States Patent [19]

Valentino et al.

[11] Patent Number: 4,571,591

[45] Date of Patent: Feb. 18, 1986

[54] THREE DIMENSIONAL, ORTHOGONAL DELAY LINE BOOTLACE LENS ANTENNA

[75] Inventors: Pasquale A. Valentino, Glen Head; John J. Stangel, Mahopac; Dwayne D. Donelin, Glen Oaks, all of N.Y.

[73] Assignee: The United States of America as represented by the Secretary of the Navy, Washington, D.C.

[21] Appl. No.: 562,336

[22] Filed: Dec. 16, 1983

[51] Int. Cl.[4] ..... H01Q 3/46

[52] U.S. Cl. ..... 343/754; 343/376; 343/840

[58] Field of Search ..... 343/754, 840, 909, 376

[56] References Cited

U.S. PATENT DOCUMENTS 4,001,834 1/1977 Smith ..... 343/754

*Primary Examiner*—Eli Lieberman

*Attorney, Agent, or Firm*—Robert F. Beers; Henry Hansen; Vincent T. Pace

[57] ABSTRACT

A bootlace microwave lens antenna has orthogonal delay lines for reducing quadratic phase errors to improve focusing capability. The collector and radiator elements consist of mutually orthogonal pairs of subelements with one of the subelements oriented radially and the other oriented tangentially on the respective collector and radiator surfaces. Individual delay lines interconnect corresponding radial and tangential subelements on each surface thus allowing for phase corrections in the axial planes parallel to and perpendicular to the plane of scan by the introduction of an appropriate phase delay in each delay line.

9 Claims, 5 Drawing Figures

THREE DIMENSIONAL, ORTHOGONAL DELAY LINE BOOTLACE LENS ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to microwave lens antennas and, more particularly, to a bootlace lens antenna which reduces quadratic phase errors by use of orthogonal independent delay lines for each bootlace element.

Many Naval applications in electronic warfare and wide-angle surveillance require a microwave antenna the response pattern of which can display a 360° azimuth and at least 90° of elevation. It can be analytically demonstrated that three dimensional (3-D) multibeam microwave bootlace lens antennas cannot be designed to achieve this hemispherical coverage due to aperture limitations. Furthermore, such bootlace lens antennas cannot provide wide angle coverage without incurring large phase errors due to their inability to accurately focus the energy for most beams in the coverage region.

In general, five perfect focal points are possible with a single layered 3-D bootlace lens antenna. That is, only five of the multiplicity of beams over the coverage region will be well focused. The remaining beams will exhibit significant defocusing and aberrational effects due to the generation of large phase errors.

Utilization of a multiple lens system provides additional degrees of freedom which affords a mechanism by which the aberration effects can be reduced. Such an antenna is described in U.S. patent application Ser. No. 06-350,796, filed Feb. 22, 1982 by Pasquale A. Valentino et al, now U.S. Pat. No. 4,458,249 issued July 3, 1984.

This antenna, however, appears to be more complex and lossy.

An alternate design is the Luneberg Lens which is a spherical lens the refraction index of which varies as a function of the radial distance from the center of the sphere. Such a lens is capable of hemispheric coverage because of the property that a feed source placed adjacent any surface point produces a collimated wavefront on the other side of the sphere which travels in the direction of the line from the feed point through the center of the sphere. However, not only is a sphere having a radially variable index of refraction difficult and expensive to construct, but also it is considerably difficult to controllably scan a feed source about the spherical surface to provide hemispheric coverage.

Prior art has demonstrated that instead of constraining the lens design via a set of equations describing perfect foci, one can design a lens based on a minimum RMS error criterion which imposes the constraint that the lens configuration be a figure of revolution. An overall reduction in the focusing error of the lens is then achieved. Analysis of the phase error structure of a bootlace lens antenna designed by this technique, however, has demonstrated that the phase errors in the principal axial planes parallel to the plane of scan (coplanar) and perpendicular to the plane of scan (crossplanar) contain significant quadratic components in opposite directions.

Furthermore, repositioning of the feed while correcting the error in one plane further distorts the error in the other plane. This error is characteristic of most three dimensional bootlace lenses for beams not coinciding with perfect foci on the lens axis.

SUMMARY OF THE INVENTION

Accordingly, one object of this invention is to provide wide angle, three-dimensional multibeam coverage over a wide RF operating bandwidth.

Another object of the invention is to provide wide angle, three-dimensional beam coverage in a bootlace lens antenna having reduced quadratic phase errors.

A further object of the invention is to provide improved focusing in a three-dimensional bootlace lens antenna without the need for auxiliary microwave lenses.

The above and other objects are realized in a microwave bootlace lens antenna having dual polarized array elements with separate delay line channels for each polarization channel of an array element. One delay line channel can be made to correspond to the coplanar channel and the other to the crossplanar channel. This is achieved by orienting the array elements radially and tangentially on the lens collector and radiator surfaces. If the feed is polarized in the plane of scan then, along the principal lens axis in the plane of scan, the radial channel becomes the coplanar channel and, hence receives the incident signal. On the other hand the tangential channel becomes the crossplanar channel which is perpendicular to the incident signal polarization. The radial channel interconnecting delay lines are then designed to minimize the phase error along the coplanar axis.

Likewise, if the feed is polarized along the crossplanar or principal lens axis perpendicular to the plane of scan, the tangential channel becomes the coplanar channel and receives the incident signal. The tangential channels are designed to minimize the phase error along the crossplanar axis. Since the lens is a figure of revolution the correction factor is independent of azimuth beam position but is a function of elevation beam position. Typically, the correction factor would be such as to minimize the average error over the elevation coverage range.

DESCRIPTION OF THE PREFERRED EMBODIMENT

Figure 1:
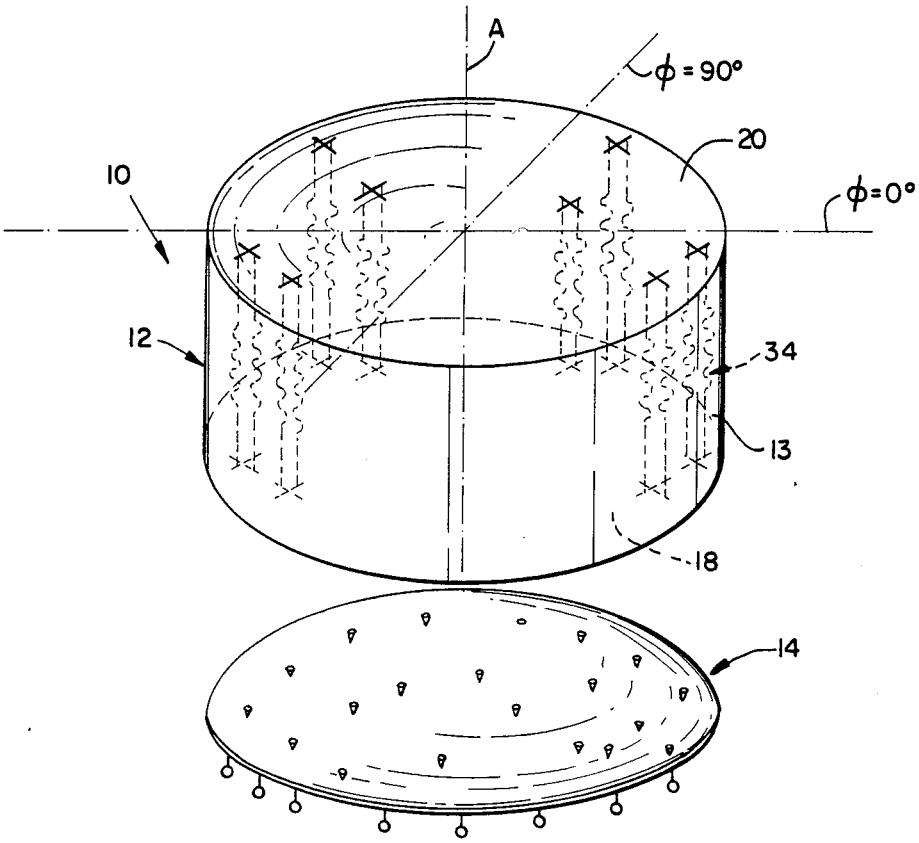
FIG. 1 illustrates an embodiment of the bootlace microwave lens antenna according to the present invention.

Referring now to the drawings wherein like reference numerals designate identical or corresponding parts among the views, and more particularly to FIG. 1, there is shown generally a bootlace microwave lens antenna 10 according to the present invention. The antenna 10 includes a multibeam lens 12 and a focal array 14 for directing a beam of microwave energy toward the lens 12.

Figure 5:
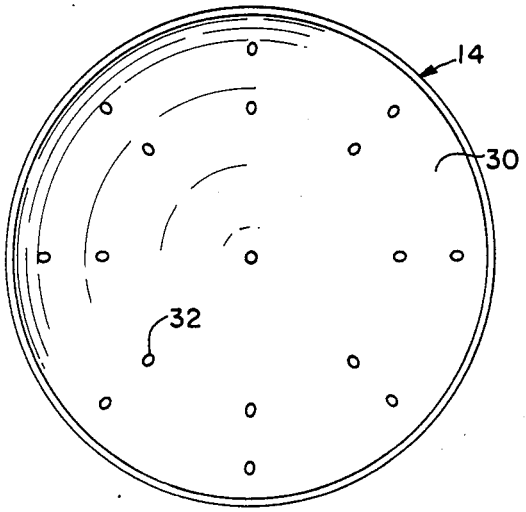
FIG. 5 is a plan view of the focal array of the lens antenna as viewed along line 5—5 of FIG. 4.
Figure 4:
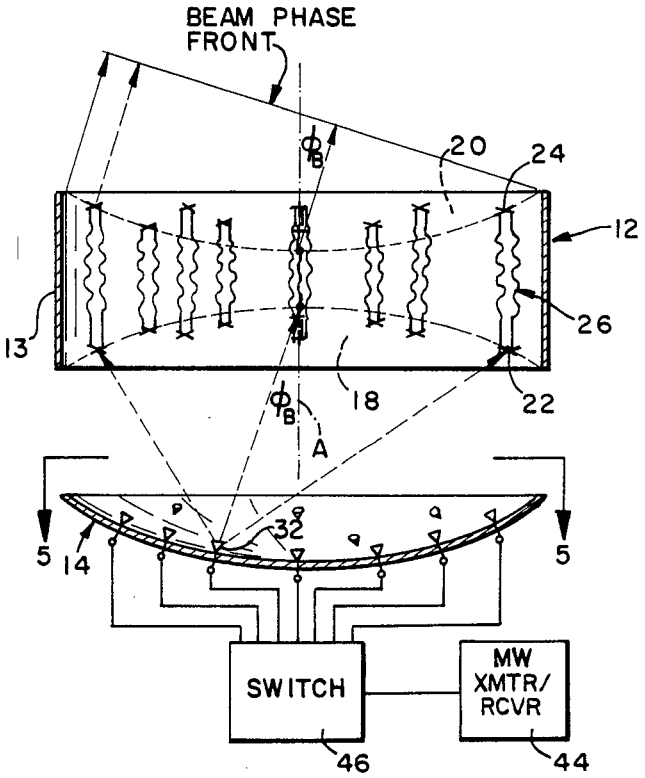
FIG. 4 is a sectional view of the lens antenna as viewed along line 4—4 of FIG. 3.

The focal array 14 includes a plurality of beamports 32 disposed along closed contours of focal rings 30 about the axis A as shown in FIGS. 4 and 5. Each of the focal rings 30 produces azimuthally invariant beams for the elevation angle corresponding to the particular ring. Each of the beamports 32 on a given focal ring 30 corresponds to a microwave beam at a particular azimuthal angle of the antenna aperture. The microwave beam is scanned by switching the signal from the microwave transmitter 44 amongst the various beamports 32 by means of an electronic switching matrix 46. The microwave signal so generated should be linearly polarized in either the coplanar (i.e., parallel to the plane of scan) or the crossplaner (i.e., perpendicular to the plane of scan) direction.

The geometry of the lens 12 is a figure of revolution which is of the constrained microwave lens type. Such a lens has arrays of antenna elements which form the lens collector and radiator surfaces. The individual elements are interconnected via transmission delay lines. RF electromagnetic energy incident on one of the lens surfaces is thus constrained to flow through the delay lines. Lens 12 and focal array 14 are circularly symmetric about axis A of antenna 10.

In the embodiment shown in FIG. 1, the multi-beam lens 12 has a collector surface 18 and a radiating surface 20. These surfaces 18 and 20 are constructed by arrangement of a plurality of lens modules 34 within a framework or housing 13. Collector surface 18 is generally contoured, but radiating surface 20 may be contoured or planar.

Figure 2:
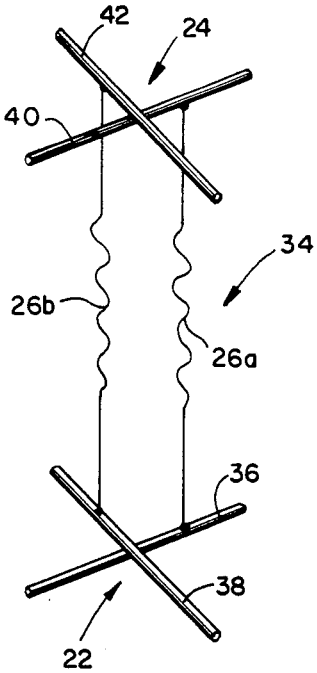
FIG. 2 illustrates an embodiment of the dual-polarized, dual channel lens module utilized in the bootlace microwave lens antenna of FIG. 1.
Figure 3:
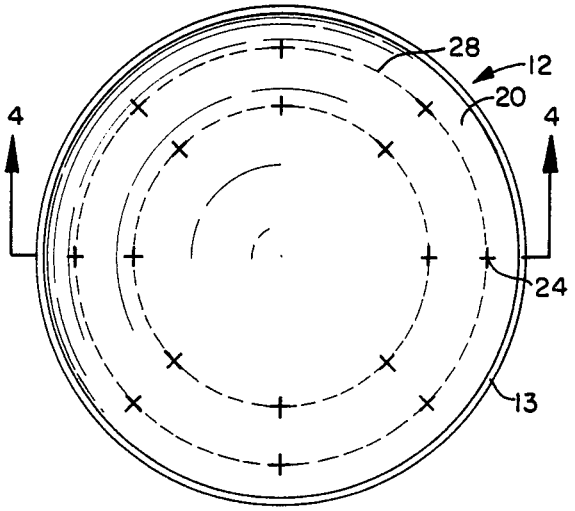
FIG. 3 is a plan view of the radiator surface of the embodiment shown in FIG. 1.

The lens modules 34 utilized in lens 12 of antenna 10 are dual-polarized and dual-channeled as shown in FIG. 2. Each lens module 34 includes a collector antenna element 22 and a radiator antenna element 24. In general, elements 22 and 24 are arrayed on respective surfaces 18 and 20 such that each collector element 22's position relative to a corresponding radiator element 24's position is prescribed by the lens design procedure for the particular lens (e.g., a minimum RMS error design procedure). In the embodiment shown in FIG. 3, the arrayed elements 24 are aligned along concentric rings 28 of constant phase delay on surface 20. However, other lattice arrangements could be utilized such as a triangular lattice. Of course, a corresponding lattice arrangement would be utilized on collector surface 18.

Respective arrayed elements 22 and 24 are interconnected by pairs of transmission delay lines 26, as shown in FIG. 4. Referring back to FIG. 2 it can be seen that each array element 22 is constructed of two mutually orthogonal subelements 36 and 38. Likewise, each radiator element 24 is formed of mutually orthogonal subelements 40 and 42.

Subelements 36, 38, 40 and 42 are oriented to the respective surfaces 18 and 20 such that one pair of corresponding subelements, for example 36 and 40 are aligned tangentially and the other pair of corresponding subelements 38 and 42 are aligned radially on their respective surfaces. Tangential subelements 36 and 40 are connected by a delay line 26*a*, and radial subelements 38 and 42 are connected by delay line 26*b*.

The subelements 36, 38, 40 and 42 may suitably comprise electric dipole array antenna elements, whereas delay lines 26*a* and 26*b* may comprise preselected lengths of microwave transmission line such as coaxial cable or printed circuit stripline having a preselected signal delay.

Subelements 36 and 40 which lie in a tangential direction can receive and radiate signals which are tangentially polarized. Likewise, subelements 38 and 42 which lie in a radial direction can receive and radiate signals which are radially polarized. Since the lens 12 has complete circular symmetry, the resultant antenna pattern characteristics of antenna 10 are invariant with azimuth beam position.

Incorporation of the orthogonal collector and radiator elements 22 and 24 increases the complexity of the lens antenna 10, but it also provides added design flexibility. The fact that each orthogonal channel has a separate delay line through lens 12 enables separate control of the delay for each channel providing an additional degree of freedom in the lens design. This can be utilized to reduce the lens focusing error thereby improving the pattern performance characteristics of the antenna 10.

For example, consider a lens having a phase error in the coplanar axis direction given by $\gamma_R = K_1 r^2$ where r is the radial distance from the lens axis A, and has a crossplanar axis phase error given by $\gamma_P = -K_2 r^2$. These errors are opposite and thus cannot be reduced merely by repositioning the beam feed. This phase error characteristic is typical of most three dimensional bootlace lens antennas.

By introducing a phase delay for offsetting $\gamma_R$ in the radial polarization channel and $\gamma_P$ in the tangential polarization channel, the net resultant phase error is reduced when antenna 10 is excited with a signal which is linearly polarized parallel to the plane of scan (i.e., in the lens axial plane containing the beam pointing direction). Conversely, correcting for $\gamma_R$ in the tangential channel and $\gamma_P$ in the radial channel results in a reduction in error when the antenna 10 is excited with a signal polarized perpendicular to the plane of scan. Thus by optimizing each of the delay lines 26*a* and 26*b* independently, collimation of the beam phase front along the coplanar and crossplanar lens axes relative to the plane of scan can be realized, resulting in a reduction in the lens focusing errors.

Some of the advantages and new features of the subject invention should now be apparent in view of the foregoing description. For example, a microwave lens antenna has been demonstrated which provides wide angle, three-dimensional, multibeam coverage but with reduced quadratic phase errors. The above described antenna thus has improved focusing capability over current designs.

Numerous modifications and variations of the subject invention are possible in light of the above teachings. For example, the bootlace microwave lens could have a planar radiating surface in lieu of the contoured surface. It is therefore to be understood that within the scope of the appended claims the invention may be practiced otherwise than as specifically described.

What is claimed is:

1. A bootlace microwave lens antenna comprising:

a constrained microwave lens body having first and second opposing surfaces, and a figure of revolution which is circularly symmetric about its principal axis;

concentric rings of dual polarized electromagnetic collector elements disposed about the principal axis on said first surface;

concentric rings of dual polarized electromagnetic radiator elements disposed about the principal axis on said second surface;

said collector and radiator elements including pairs of mutually orthogonal subelements each respectively aligned radially and tangentially in said concentric rings; and a plurality of preselected lengths of electromagnetic conduit interconnecting respective ones of said collector elements with respective ones of said radiator elements.

2. A microwave lens antenna as recited in claim 1 wherein the interconnecting electromagnetic conduits comprise first individual delay lines for connecting respective radial collector subelements to corresponding radial radiator subelements and second individual delay lines for connecting respective tangential collector subelements to corresponding tangential radiator subelements.

3. A microwave lens antenna as recited in claim 2 wherein the first and second delay lines comprise phase delay means for offsetting the lens phase error along the lens coplanar axis and along the crossplanar axis relative to the plane of scan.

4. A microwave lens antenna as recited in claim 3 wherein the first and second opposing surfaces are contoured.

5. A microwave lens antenna as recited in claim 3 wherein the first surface is contoured and the second surface is planar.

6. A microwave lens antenna as recited in claim 3 further comprising a focal array disposed adjacent to the first surface for directing a beam of microwave energy toward said first surface.

7. A microwave lens antenna as recited in claim 6 wherein the focal array comprises a plurality of focal elements disposed along concentric focal rings centered about an axis which coincides with the principal axis of the microwave lens body.

8. A bootlace microwave lens antenna comprising:

a lens housing having the form of a figure of revolution which is circularly symmetric about its principal axis;

a plurality of lens modules disposed along concentric rings of constant phase within said housing such that the ends of said lens modules form first and second opposing contoured surfaces, each module including a dual polarized electromagnetic collector element having a subelement aligned radially and a subelement aligned tangentially on said first surface, a dual polarized electromagnetic radiator element having a subelement aligned radially and a subelement aligned tangentially on said second surface, and a pair of signal delay lines having a first coaxial cable of predetermined length for interconnecting respective ones of said radially aligned subelements on each surface and a second coaxial cable of predetermined length for interconnecting respective ones of said tangentially aligned subelements on each surface; and a focal array disposed adjacent to said first surface for directing a beam of microwave energy toward said first surface.

9. An improved bootlace microwave lens antenna of the type having a general constrained lens with two opposing surfaces in which one surface is constructed of an array of receiving elements and the second surface is constructed of a similar array of radiating elements connected one to one with the elements of the first surface by lengths of transmission line, and a focal array for directing microwave energy toward said first surface wherein the improvement comprises:

the receiving elements further comprising radially and tangentially aligned subelements arranged to form mutually orthogonal subelement pairs on said first surface;

the radiating elements further comprising radially and tangentially aligned subelements arranged to form mutually orthogonal subelement pairs on said second surface; and the interconnecting transmission lines further comprising predetermined lengths of coaxial cable connected between corresponding radial and tangential subelements on each surface, said lengths of coaxial cable being selected to provide sufficient phase delay for offsetting lens phase errors in both the coplanar and crossplanar axial directions, whereby the beam forming characteristics of the antenna are optimized over a prescribed spatial coverage sector.

* * * * *